US011437691B2

(12) United States Patent
Jing et al.

(10) Patent No.: US 11,437,691 B2
(45) Date of Patent: Sep. 6, 2022

(54) DIELECTRIC WAVEGUIDE FILTER WITH TRAP RESONATOR

(71) Applicant: CTS Corporation, Lisle, IL (US)

(72) Inventors: Dong Jing, Rio Rancho, NM (US); Reddy Vangala, Albuquerque, NM (US)

(73) Assignee: CTS CORPORATION, Lisle, IL (US)

( * ) Notice: Subject to any disclaimer, the term of this patent is extended or adjusted under 35 U.S.C. 154(b) by 58 days.

(21) Appl. No.: 16/909,586

(22) Filed: Jun. 23, 2020

(65) Prior Publication Data

US 2020/0411935 A1 Dec. 31, 2020

Related U.S. Application Data

(60) Provisional application No. 62/866,867, filed on Jun. 26, 2019.

(51) Int. Cl.
*H01P 3/16* (2006.01)
*H01P 1/20* (2006.01)

(52) U.S. Cl.
CPC ..... *H01P 1/2002* (2013.01); *H01P 3/16* (2013.01)

(58) Field of Classification Search
CPC ..... H01P 1/2002; H01P 1/20; H01P 1/201; H01P 1/207; H01P 1/208; H01P 1/2084;
(Continued)

(56) References Cited

U.S. PATENT DOCUMENTS 3,882,434 A 5/1975 Levy
3,955,161 A 5/1976 MacTurk
4,396,896 A 8/1983 Williams
4,431,977 A 2/1984 Sokola et al.
(Continued)

FOREIGN PATENT DOCUMENTS

CN 1398014 A 2/2003
CN 1507109 A 6/2004
(Continued)

OTHER PUBLICATIONS

Ruiz-Cruz J et al.: "Rectangular Waveguide Elliptic Filters with Capacitive and Inductive Irises and Integrated Coaxial Excitation", 2005 IEEE MTT-S International Microwave Symposium, Piscataway, NJ, USA, IEEE, (Jun. 12, 2005) pp. 269-272, EP010844740, DOI: 10.1109/MWSYM.2005.1516577, ISBN: 978-0-7803-8846-8 p. 269; figures 1,3.
Paul Wade: "Rectangular Waveguide to Coax Transition Design", QEX, Nov./Dec. 2006, pp. 10-17, published by American Radio Relay League, Newington, Connecticut, US.
(Continued)

*Primary Examiner* — Stephen E. Jones
(74) *Attorney, Agent, or Firm* — Michael Best & Friedrich LLP

(57) ABSTRACT

A dielectric waveguide filter with a first solid block of dielectric material covered with a layer of conductive material and defining a plurality of resonators. A first RF signal input/output through-hole is defined in a first end resonator of the plurality of resonators of the first block of dielectric material. A second solid block of dielectric material is coupled to the first solid block of dielectric material. The second block of dielectric material is covered with a layer of conductive material and defines a plurality of resonators including first and second adjacent end resonators separated by an RF signal isolator for preventing the transmission of
(Continued)

an RF signal between the first and second end resonators. An RF signal coupling window provides a coupling between the first end resonator of the plurality of resonators of the first block of dielectric material and the first end resonator of the second block of dielectric material whereby the first end resonator of the second block of dielectric material defines a trap resonator.

12 Claims, 7 Drawing Sheets

(58) Field of Classification Search
CPC ..... H01P 1/2086; H01P 1/2088; H01P 3/16; H01P 3/122; H01P 3/112; H01P 3/12; H01P 3/121; H01P 7/10; H01P 7/105
See application file for complete search history.

(56) References Cited

U.S. PATENT DOCUMENTS 4,609,892 A 9/1986 Higgins, Jr.
4,692,726 A 9/1987 Green et al.
4,706,051 A 11/1987 Dieleman et al.
4,773,208 A 3/1988 Ishikawa et al.
4,742,562 A 5/1988 Kommrusch
4,800,348 A 1/1989 Rosar et al.
4,806,889 A 2/1989 Nakano et al.
4,837,535 A 6/1989 Konishi et al.
4,940,955 A 7/1990 Higgins, Jr.
4,963,844 A 10/1990 Konishi et al.
4,996,506 A 2/1991 Ishikawa et al.
5,004,992 A 4/1991 Grieco et al.
5,023,944 A 6/1991 Bradley
5,130,682 A 7/1992 Agahi-Kesheh
5,130,683 A 7/1992 Agahi-Kesheh et al.
5,208,565 A 5/1993 Sogo et al.
5,243,309 A 9/1993 L'Ecuyer
5,288,351 A 2/1994 Hoang et al.
5,285,570 A 5/1994 Fulinara
5,365,203 A 11/1994 Nakamura et al.
5,382,931 A 1/1995 Piloto et al.
5,416,454 A 5/1995 McVetty
5,525,946 A 6/1996 Tsujiguchi et al.
5,528,204 A 6/1996 Hoang et al.
5,528,207 A 6/1996 Ito
5,537,082 A 7/1996 Tada et al.
5,572,175 A 11/1996 Tada et al.
5,602,518 A 2/1997 Clifford, Jr. et al.
5,719,539 A 2/1998 Ishizaki et al.
5,731,751 A 3/1998 Vangala
5,821,836 A 10/1998 Katehi et al.
5,850,168 A 12/1998 McVetty et al.
5,926,078 A 7/1999 Hino et al.
5,926,079 A 7/1999 Heine et al.
5,929,726 A 7/1999 Ito et al.
5,999,070 A 12/1999 Endo
6,002,306 A 12/1999 Arakawa et al.
6,016,091 A 1/2000 Hidaka et al.
6,023,207 A 2/2000 Ito et al.
6,026,281 A 2/2000 Yorita
6,104,261 A 8/2000 Sonoda et al.
6,137,383 A 10/2000 De Lillo
6,154,106 A 11/2000 De Lillo
6,160,463 A 12/2000 Arakawa et al.
6,181,225 B1 1/2001 Bettner
6,255,921 B1 7/2001 Arakawa et al.
6,281,764 B1 8/2001 Arakawa et al.
6,329,890 B1 12/2001 Brooks et al.
6,351,198 B1 2/2002 Tsukamoto et al.
6,437,655 B1 8/2002 Andoh et al.
6,504,446 B1 1/2003 Ishihara et al.
6,507,252 B1 1/2003 Ho et al.
6,535,083 B1 3/2003 Hageman et al.
6,549,095 B2 4/2003 Tsukamoto et al.
6,556,106 B1 4/2003 Sano et al.
6,559,740 B1 5/2003 Schulz et al.
6,568,067 B2 5/2003 Takeda
6,570,467 B2 5/2003 Walker et al.
6,594,425 B2 7/2003 Tapalian et al.
6,650,202 B2 11/2003 Rogozine et al.
6,677,837 B2 1/2004 Kojima et al.
6,757,963 B2 7/2004 Meier et al.
6,791,403 B1 9/2004 Tayrani et al.
6,801,106 B2 10/2004 Ono et al.
6,834,429 B2 12/2004 Blair et al.
6,844,861 B2 1/2005 Peterson
6,888,973 B2 5/2005 Kolodziejski et al.
6,900,150 B2 5/2005 Jacquin et al.
6,909,339 B2 6/2005 Yonekura et al.
6,909,345 B1 6/2005 Salmela et al.
6,927,653 B2 8/2005 Uchimura et al.
6,977,560 B2 12/2005 Iroh et al.
6,977,566 B2 12/2005 Fukunaga
7,009,470 B2 3/2006 Yatabe et al.
7,068,127 B2 6/2006 Wilber et al.
7,075,388 B2 7/2006 Rogozine et al.
7,132,905 B2 11/2006 Sano
7,142,074 B2 11/2006 Kim et al.
7,170,373 B2 1/2007 Ito et al.
7,271,686 B2 9/2007 Koshikawa et al.
7,321,278 B2 1/2008 Vangala
7,323,954 B2 1/2008 Lee et al.
7,449,979 B2 11/2008 Koh et al.
7,545,235 B2 6/2009 Mansour et al.
7,659,799 B2 2/2010 Jun et al.
7,714,680 B2 5/2010 Vangala et al.
7,877,855 B2 2/2011 Chuang et al.
8,008,993 B2 8/2011 Milson et al.
8,072,294 B2 12/2011 Tanpo et al.
8,171,617 B2 5/2012 Vangala
8,284,000 B2 10/2012 Fukunaga
8,314,667 B2 11/2012 Uhm et al.
8,823,470 B2 9/2014 Vangala
8,860,532 B2 10/2014 Gong et al.
9,030,278 B2 5/2015 Vangala
9,030,279 B2 5/2015 Vangala
9,077,062 B2 7/2015 Brady
9,130,255 B2 9/2015 Rogozine et al.
9,130,256 B2 9/2015 Rogozine et al.
9,130,257 B2 9/2015 Vangala
9,130,258 B2 9/2015 Vangala et al.
9,431,690 B2 8/2016 Rogozine et al.
9,437,908 B2 9/2016 Vangala
9,437,909 B2 9/2016 Vangala et al.
9,466,864 B2 10/2016 Rogozine et al.
9,666,921 B2 5/2017 Rogozine et al.
10,050,321 B2 8/2018 Rogozine et al.
10,116,028 B2 10/2018 Vangala
2001/0024147 A1 9/2001 Arkawa et al.
2002/0024410 A1 2/2002 Guglielmi et al.
2003/0006865 A1 1/2003 Kim et al.
2004/0000968 A1 1/2004 White et al.
2004/0056737 A1 3/2004 Carpintero et al.
2004/0129958 A1 7/2004 Kho et al.
2004/0257194 A1 12/2004 Casey et al.
2005/0057402 A1 3/2005 Ohno et al.
2007/0120628 A1 5/2007 Jun et al.
2009/0015352 A1 1/2009 Goebel et al.
2009/0102582 A1 4/2009 Van Der Heijden et al.
2009/0146761 A1 6/2009 Nummerdor
2009/0201106 A1 8/2009 Iio et al.
2009/0231064 A1 9/2009 Bates et al.
2010/0024973 A1 2/2010 Vangala
2010/0253450 A1 10/2010 Kim et al.
2011/0032050 A1 2/2011 Kouki et al.
2011/0279200 A1 11/2011 Vangala
2012/0049983 A1 3/2012 Uhm et al.
2012/0229233 A1 9/2012 Ito
2012/0286901 A1 11/2012 Vangala
2013/0214878 A1 8/2013 Gorisee et al.
2014/0077900 A1 3/2014 Rogozine et al.
2014/0152403 A1 6/2014 Park
2014/0266514 A1 9/2014 Rogozine et al.

(56) References Cited

U.S. PATENT DOCUMENTS

| | | | |
|---|---|---|---|
| 2015/0084720 | A1 | 3/2015 | Vangala et al. |
| 2015/0295294 | A1 | 10/2015 | Rogozine et al. |
| 2016/0308264 | A1 | 10/2016 | Vangala |
| 2018/0301781 | A1 | 10/2018 | Peng et al. |
| 2019/0067773 | A1 | 2/2019 | Vangala |

FOREIGN PATENT DOCUMENTS

| | | | |
|---|---|---|---|
| CN | 201898182 | U | 7/2011 |
| CN | 102361113 | A | 2/2012 |
| CN | 203218423 | U | 9/2013 |
| CN | 102361113 | B | 8/2014 |
| CN | 109449557 | A | 3/2019 |
| CN | 109509945 | A | 3/2019 |
| CN | 208806343 | U | 4/2019 |
| DE | 2056528 | A1 | 5/1972 |
| DE | 102008017967 | A1 | 10/2009 |
| EP | 0322993 | A2 | 7/1989 |
| EP | 0322993 | A3 | 4/1990 |
| EP | 0444948 | A2 | 3/1991 |
| EP | 0757401 | A2 | 2/1997 |
| EP | 0859423 | A1 | 8/1998 |
| EP | 1024548 | A1 | 2/2000 |
| EP | 0997964 | A2 | 5/2000 |
| EP | 0997964 | A3 | 9/2001 |
| EP | 1278264 | A1 | 1/2003 |
| EP | 1439599 | A1 | 7/2004 |
| FR | 2318512 | A1 | 2/1977 |
| JP | 62038601 | | 2/1987 |
| JP | 02-090801 | | 3/1990 |
| JP | 6-177607 | A | 6/1994 |
| JP | 6177607 | | 6/1994 |
| JP | 10173407 | | 6/1998 |
| JP | 2000286606 | A | 10/2000 |
| JP | 2001-339204 | A | 12/2001 |
| JP | 3405783 | B2 | 3/2003 |
| JP | 2003298313 | | 10/2003 |
| JP | 2005-269012 | A | 9/2005 |
| JP | 2006157486 | | 6/2006 |
| JP | 2006340141 | | 12/2006 |
| JP | 2010028381 | A | 2/2010 |
| JP | 2010-130663 | A | 6/2010 |
| JP | 2011244451 | A | 12/2011 |
| KR | 2003-0007057 | A | 1/2003 |
| KR | 10-0399041 | B1 | 9/2003 |
| KR | 10-0522726 | B1 | 10/2005 |
| KR | 10-0586502 | B1 | 5/2006 |
| KR | 10-0852487 | B1 | 8/2008 |
| KR | 10-0866978 | B1 | 11/2008 |
| KR | 10-0906215 | B1 | 7/2009 |
| KR | 10-0932705 | B1 | 12/2009 |
| KR | 10-2010-0030862 | A | 3/2010 |
| KR | 10-0954801 | B1 | 4/2010 |
| KR | 10-0995758 | B1 | 11/2010 |
| KR | 10-1001935 | B1 | 12/2010 |
| KR | 10-1081419 | B1 | 11/2011 |
| KR | 10-1126183 | B1 | 3/2012 |
| KR | 20130020632 | | 2/2013 |
| KR | 10-1431005 | B1 | 8/2014 |
| KR | 10-1442220 | B1 | 9/2014 |
| KR | 10-1581687 | B1 | 12/2015 |
| KR | 10-1616768 | B1 | 4/2016 |
| KR | 1020170048753 | A | 5/2017 |
| KR | 10-1919456 | B1 | 2/2019 |
| WO | 199509451 | | 4/1995 |
| WO | 2000024080 | | 4/2000 |
| WO | 0038270 | A1 | 6/2000 |
| WO | 02078119 | A1 | 10/2002 |
| WO | 2005091427 | | 9/2005 |
| WO | 2013012438 | A1 | 1/2013 |
| WO | 2015090107 | A1 | 6/2015 |

OTHER PUBLICATIONS

Yoji Isota, Moriyasu Miyazaki, Osami Ishida, Fumio Takeda, Mitsubishi Electric Corporation. "A Grooved Monoblock Comb-Line Filter Suppressing the Third Harmonics", IEEE 1987 MTT-S Digest, pp. 383-386, published by IEEE, New York, New York, US.

C. Choi, Fig 2.13, Monolithic Plated Ceramic Waveguide Filters, Mar. 31, 1986, Motorola, Inc., Schaumburg, Illinois, U.S.

Kocbach J. et al.: "Design Procedure for Waveguide Filters with Cross-Couplings", 2002 IEEE MTT-S International Microwave Symposium Digest (Cat. No. 02CH37278) IEEE Piscataway, NJ, USA; IEEE MTT-S International Microwave Symposium, IEEE, Jun. 2, 2002, pp. 1449-1452, XP001113877, DOI: 10.1109/WMSYM.2002.1012128 ISBN: 978-0-8703-7239-9 abstract; figure 1.

N. Marcuvilz, Waveguide Handbook, McGraw-Hill Book Co., New York City, Ch. 5, 1951.

Y. Konishi, "Novel dielectric waveguide components-microwave applications of new ceramic materials," Proc. IEEE, vo. 79, pp. 726-740, Jun. 1991.

K. Sano, "Dielectric waveguide filter with low profile and low insertion loss," IEEE Trans. on Microwave Theory & Tech., vol. 47, pp. 2299-2303, Dec. 1999.

K. Sano and T. Yoneyama, "A transition from Microstrip to Dielectric Filled Rectangular Waveguide in Surface Mounting," IEEE MTT-S Int. Microwave Symp. Digest, pp. 813-816, 2002.

I. Awai, A.C. Kundu, and T. Yamashita, "Equivalent circuit representation and explanation of attenuation poles of a dual-mode dielectric resonator bandpass filter," IEEE Trans. Microwave Theory & Tech., vol. 46, pp. 2159-2163, Dec. 1998.

A.D. Lapidus and C. Rossiter, "Cross-coupling in microwave bandpass filters," Microwave Journal, pp. 22-46, Nov. 2004.

Tze-min Shen; Chi-Feng Chen' Huang, Ting-Yi; Wu, Ruey-Beei, "Design of Vertically Stacked Waveguide Filters in LTCC," Microwave Theory and Techniques, IEEE Transactions on, vol. 55, No. 8, pp. 1771, 1779, Aug. 2007.

Hung-Yi Chien; Tze-Min Shen; Huang; Ting-Yi; Wei-Hsin Wang; Wu, Ruey-Beei, "Miniaturized Bandpass Filters with Double-Folded Substrate Integrated Resonators in LTCC," Microwave Theory and Techniques, IEEE Transactions on vol. 57, No. 7, pp. 1774, 1782, Jul. 2009.

Bo-Jiun Chen; Tze-Min Shen; Wu, Ruey-Beei, "Dual-Band Vertically Stacked Laminated Waveguide Filter Design in LTCC Technology," Microwave Theory and Techniques, IEEE Transactions on, vol. 57, No. 6, pp. 1554, 1562, Jun. 2009.

Wolfram Wersing, Microwave ceramics for resonators and filters, Current Opinion in Solid State and Materials Science, vol. 1, Issue 5, Oct. 1996, pp. 715-731, ISSN 1359-0286.

Shen T et al., Full-Wave Design of Canonical Waveguide Filters by Optimization, 2001 IEEE MTT-S International Microwave Symposium Digest. (IMS 2001) Phoenix, AZ, May 20-25, 2001, pp. 1487-1490.

John David Rhodes, The Generalized Direct-Coupled Cavity Linear Phase Filter, IEEE Transactions on Microwave Theory and Techniques, vol. MTT-18, No. 6, Jun. 1, 1970 (Jun. 1, 1970), pp. 308-313, XP001401320, abstract.

Y. Cassivi et al., Low-Cost and High-Q Millimeter-Wave Resonator Using Substrate Integrated Waveguide Technique, Microwave Conference, 2002 32nd European, pp. 1-4.

Emilio Amieri et al., Coaxially Fed Substrate Integrated Radiating Waveguides, Antennas and Propogation Society International Symposium, 2007 IEEE, pp. 2718-2721.

DIELECTRIC WAVEGUIDE FILTER WITH TRAP RESONATOR

CROSS-REFERENCE TO RELATED AND CO-PENDING APPLICATIONS

This application claims the benefit of the filing date and disclosure of U.S. Provisional Application Ser. No. 62/866,867 filed on Jun. 26, 2019, the contents of which are entirely incorporated herein by reference as are all of references cited therein.

FIELD OF THE INVENTION

The invention relates generally to dielectric waveguide filters and, more specifically, to a dielectric waveguide filter with a trap resonator.

BACKGROUND OF THE INVENTION

This invention is related to a dielectric waveguide filter of the type disclosed in U.S. Pat. No. 5,926,079 to Heine et al. in which a plurality of resonators are spaced longitudinally along the length of a monoblock and in which a plurality of slots/notches are spaced longitudinally along the length of the monoblock and define a plurality of bridges between the plurality of resonators which provide a direct inductive/capacitive coupling between the plurality of resonators.

The attenuation characteristics of a waveguide filter of the type disclosed in U.S. Pat. No. 5,926,079 to Heine et al. can be increased through the incorporation of zeros in the form of additional resonators located at one or both ends of the waveguide filter. A disadvantage associated with the incorporation of additional resonators, however, is that it also increases the length of the filter which, in some applications, may not be desirable or possible due to, for example, space limitations on a customer's motherboard.

The attenuation characteristics of a filter can also be increased by both direct and cross-coupling the resonators as disclosed in, for example, U.S. Pat. No. 7,714,680 to Vangala et al. which discloses a monoblock filter with both inductive direct coupling and quadruplet cross-coupling of resonators created in part by respective metallization patterns which are defined on the top surface of the filter and extend between selected ones of the resonator through-holes to provide the disclosed direct and cross-coupling of the resonators.

Direct and cross-coupling of the type disclosed in U.S. Pat. No. 7,714,680 to Vangala et al. and comprised of top surface of metallization patterns is not applicable in waveguide filters of the type disclosed in U.S. Pat. No. 5,926,079 to Heine et al. which includes only slots and no top surface metallization patterns.

The present invention is thus directed to a dielectric waveguide filter with a trap resonator.

SUMMARY OF THE INVENTION

The present invention is generally directed to a dielectric waveguide filter comprising a first solid block of dielectric material covered with a layer of conductive material and defining a plurality of resonators, a second solid block of dielectric material coupled to the first solid block of dielectric material, the second block of dielectric material covered with a layer of conductive material and defining a plurality of resonators including first and second adjacent resonators separated by an RF signal isolator for preventing the transmission of an RF signal between the first and second resonators, and an RF signal coupling window providing a coupling between a first one of the plurality of resonators of the first block of dielectric material and the first resonator of the second block of dielectric material whereby the first resonator of the second block of dielectric material defines a trap resonator.

In one embodiment, the first RF signal input/output is defined on an end one of the plurality of resonators of the first solid block of dielectric material and the first and second adjacent resonators of the second solid block of dielectric material comprised end ones of the resonators of the second solid block of dielectric material.

In one embodiment, the RF signal isolator comprises a plurality of spaced apart through-holes positioned between the first and second adjacent resonators.

In one embodiment, the RF signal coupling window is defined by a region on the first and second solid blocks of dielectric material that is devoid of conductive material.

In one embodiment, a first RF signal input/output through-hole is defined in the first one of the plurality of resonators of the first block of dielectric material.

In one embodiment, a third solid block of dielectric material is covered with a layer of conductive material and defines the trap resonator, the third solid block of dielectric material being coupled to the first and second solid blocks of dielectric material in a relationship abutting an end region of the first solid block of dielectric material and adjacent an end of the second block of dielectric material.

In one embodiment, an elongate slot is defined between the second and third solid blocks of dielectric material, the elongate slot defining the RF signal isolator for preventing the transmission of the RF signal between the second and third solid blocks of dielectric material.

In one embodiment, the RF signal coupling window is defined by a capacitive coupling isolated pad of conductive material on the first and third solid blocks of dielectric material.

The present invention is also directed to a dielectric waveguide filter comprising a first solid block of dielectric material covered with a layer of conductive material and defining a plurality of resonators, a first RF signal input/output through-hole defined in a first end resonator of the plurality of resonators of the first block of dielectric material, a second solid block of dielectric material coupled to the first solid block of dielectric material, the second block of dielectric material covered with a layer of conductive material and defining a plurality of resonators including first and second adjacent end resonators separated by an RF signal isolator for preventing the transmission of an RF signal between the first and second end resonators, and an RF signal coupling window for providing a coupling between the first end resonator of the plurality of resonators of the first block of dielectric material and the first end resonator of the second block of dielectric material whereby the first end resonator of the second block of dielectric material defines a trap resonator.

In one embodiment, the RF signal isolator comprises a plurality of spaced apart through-holes positioned between the first and second adjacent resonators.

In one embodiment, the RF signal coupling window is defined by a region on the first and second solid blocks of dielectric material that is devoid of conductive material.

In one embodiment, a first RF signal input/output is defined on the first one of the plurality of resonators of the first block of dielectric material.

In one embodiment, a third solid block of dielectric material is covered with a layer of conductive material and defines the trap resonator, the third solid block of dielectric material being coupled to the first and second solid blocks of dielectric material in a relationship abutting the end resonator of the first solid block of dielectric material and adjacent an end of the second block of dielectric material.

In one embodiment, an elongate slot is defined between the second and third solid blocks of dielectric material, the elongate slot defining the RF signal isolator for preventing the transmission of the RF signal between the second and third solid blocks of dielectric material.

In one embodiment, the RF signal coupling window is defined by a capacitive coupling isolated pad of conductive material on the first and third solid blocks of dielectric material.

The present invention is further directed to a dielectric waveguide filter comprising a first solid block of dielectric material covered with a layer of conductive material and defining a plurality of resonators, a second solid block of dielectric material coupled to the first solid block of dielectric material, the second block of dielectric material covered with a layer of conductive material and defining a plurality of resonators including a first end resonator, a third solid block of dielectric material coupled to the first solid block of dielectric material and positioned adjacent an end of the second solid block of dielectric material and defining a resonator, a slot between the second and third solid blocks of dielectric material and defining an RF signal isolator for preventing the transmission of an RF signal between the first end resonator of the second solid block of dielectric material and the resonator of the third solid block of dielectric material, and an RF signal coupling window providing a coupling between a first one of the plurality of resonators of the first block of dielectric material and the resonator of the third block of dielectric material whereby the resonator of the third block of dielectric material defines a trap resonator.

Other advantages and features of the present invention will be more readily apparent from the following detailed description of the preferred embodiment of the invention, the accompanying drawings, and the appended claims.

BRIEF DESCRIPTION OF THE DRAWINGS

These and other features of the invention can best be understood by the following description of the accompanying FIGS. as follows.

DETAILED DESCRIPTION OF THE EMBODIMENTS

Figure 1:
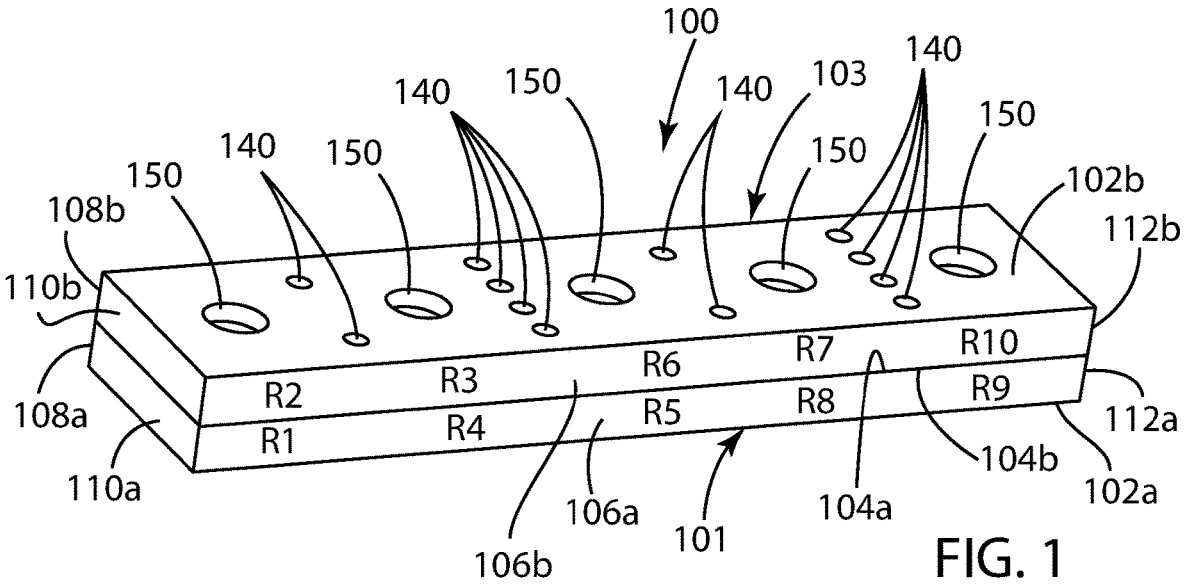
FIG. 1 is a top perspective view of a dielectric waveguide filter according to the present invention.
Figure 2:
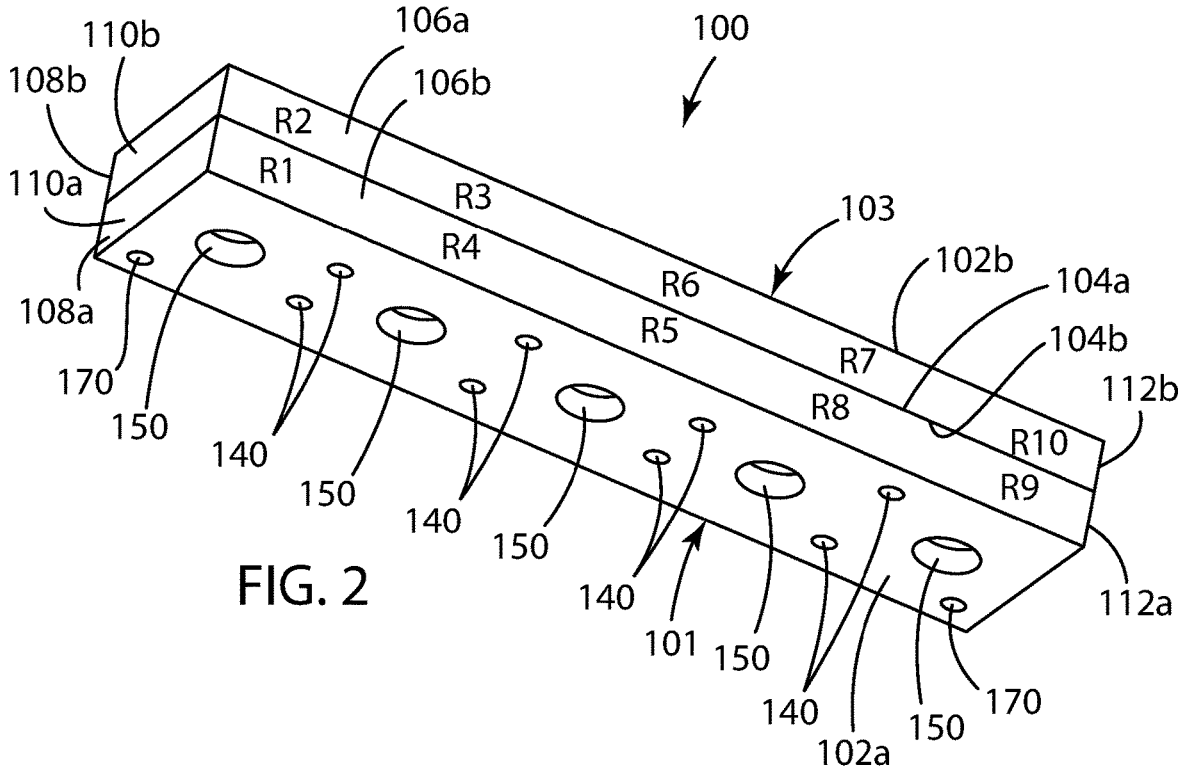
FIG. 2 is a bottom perspective view of the dielectric waveguide filter shown in FIG. 1.
Figure 3:
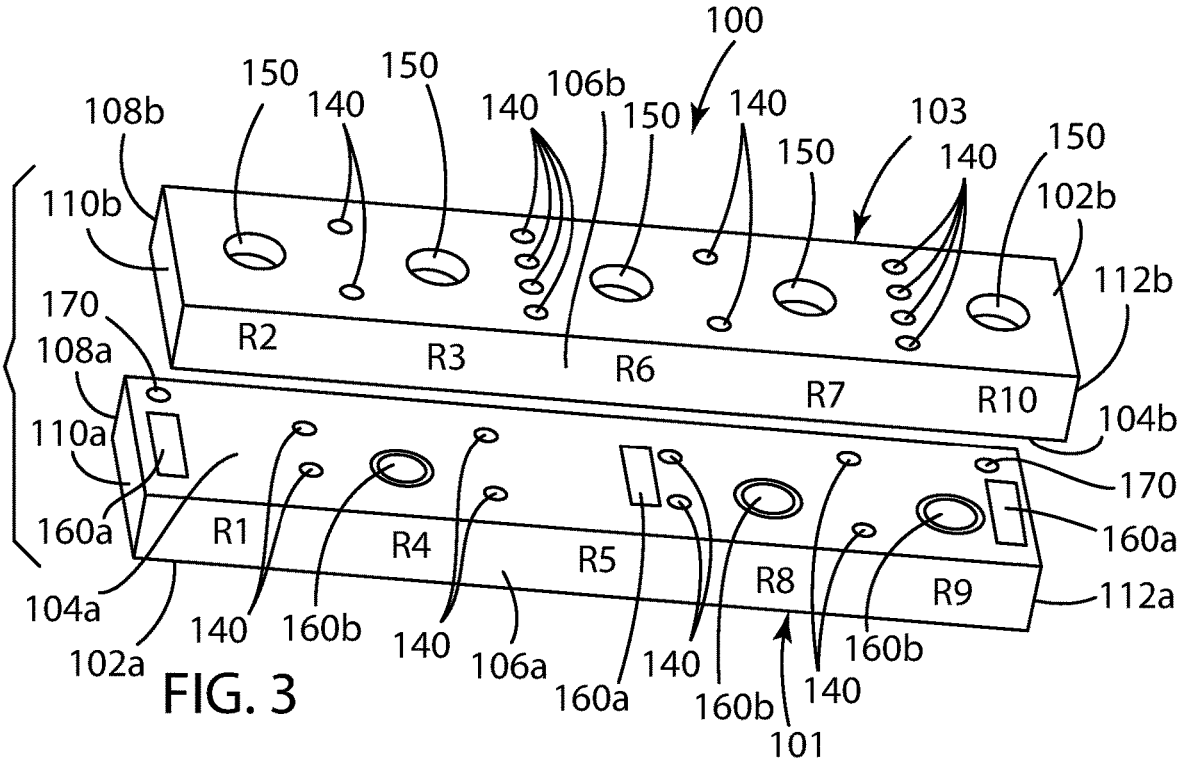
FIG. 3 is an exploded perspective view of the dielectric waveguide filter shown in FIG. 1.
Figure 4:
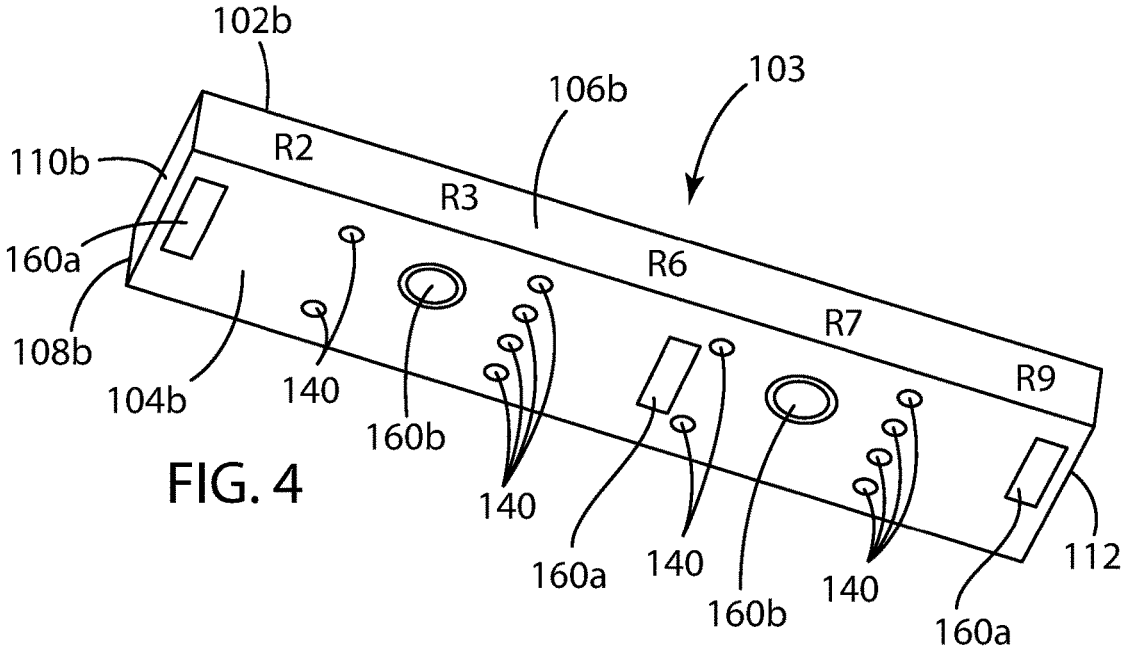
FIG. 4 is a bottom perspective view of the top block of the dielectric waveguide filter shown in FIG. 1.
Figure 5:
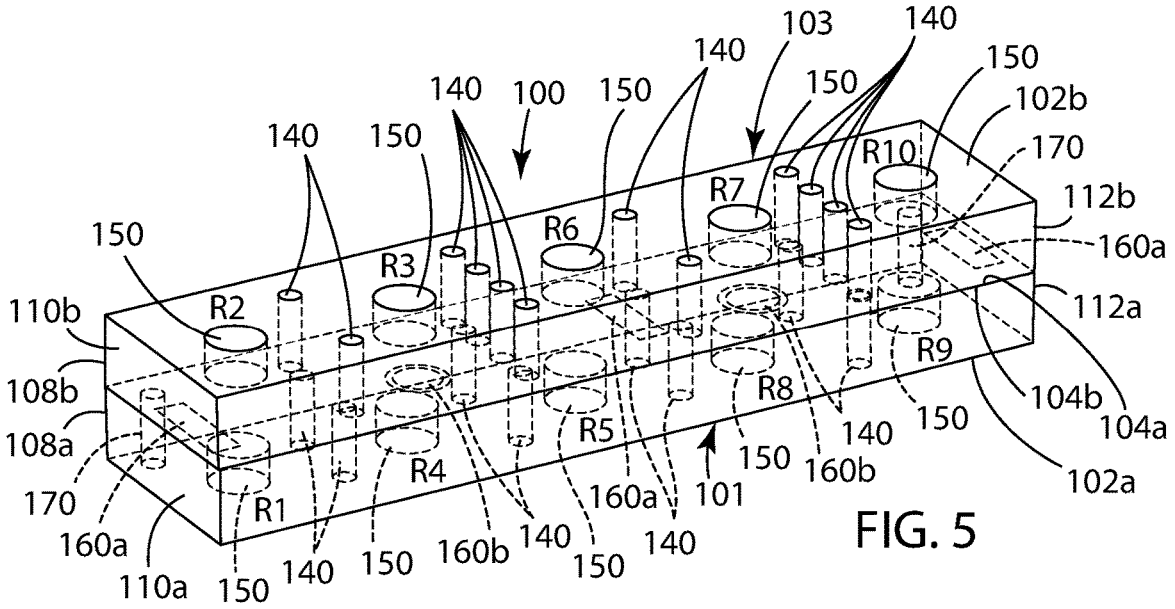
FIG. 5 is a part phantom perspective view of the dielectric waveguide filter shown in FIG. 1.

FIGS. 1 through 7 depict a waveguide filter 100 in accordance with the present invention.

In the embodiment shown, the waveguide filter 100 is made from a pair of separate generally parallelepiped-shaped monoblocks or solid blocks of dielectric material 101 and 103 which have been coupled and abutted together in a stacked relationship to form the waveguide filter 100.

The monoblock 101 is comprised of a suitable solid block or core of dielectric material, such as for example ceramic, and includes opposed longitudinal horizontal exterior surfaces 102*a* and 104*a*, opposed longitudinal side vertical exterior surfaces 106*a* and 108*a* that are disposed in a relationship normal to and extend between the horizontal exterior surfaces 102*a* and 104*a*, and opposed transverse end side vertical exterior end surfaces 110*a* and 112*a* that are disposed in a relationship generally normal to and extend between the longitudinal horizontal exterior surfaces 102*a* and 104*a* and the longitudinal vertical exterior surfaces 102*a* and 102*b*.

Thus, in the embodiment shown, each of the surfaces 102*a*, 104*a*, 106*a*, and 108*a* extends in the same direction as the longitudinal axis of the monoblock 101 and each of the end surfaces 110*a* and 112*a* extends in a direction transverse or normal to the direction of the longitudinal axis of the monoblock 101.

The monoblock 103 is also comprised of a suitable solid block or core of dielectric material, such as for example ceramic, and includes opposed longitudinal horizontal exterior surfaces 102*b* and 104*b*, opposed longitudinal side vertical exterior surfaces 106*b* and 108*b* disposed in a relationship normal to and extending between the horizontal exterior surfaces 102*b* and 104*b*, and opposed transverse end side vertical exterior surfaces 110*b* and 112*b* disposed in a relationship normal to and extending between the horizontal exterior surfaces 102*b* and 104*b* and the longitudinal side vertical exterior surfaces 106*b* and 108*b*.

Thus, in the embodiment shown, each of the surfaces 102*b*, 104*b*, 106*b*, and 108*b* extends in the same direction as the longitudinal axis of the monoblock 103 and each of the surfaces 110*b* and 112*b* extends in a direction transverse or normal to the direction of the longitudinal axis of the monoblock 103.

The monoblocks 101 and 103 include and define respective first and second pluralities of resonant sections (also referred to as cavities or cells or resonators) R1, R4, R5, R8, and R9 on monoblock 101 and R2, R3, R6, R7, and R10 on monoblock 103 which are spaced longitudinally along the length of and extend co-linearly with and in the same direction as the longitudinal axis of the respective monoblocks 101 and 103. In the embodiment shown, each of the monoblocks 101 and 103 includes and defines five resonators although it is understood that the monoblocks 101 and 103 can include less or more than five resonators depending upon the application.

Figure 6:
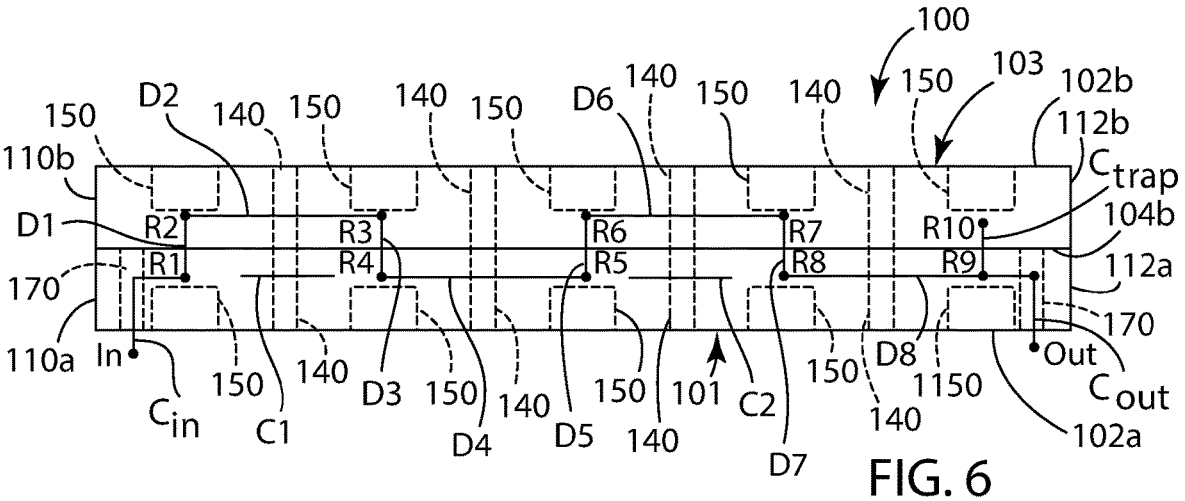
FIG. 6 is a part phantom vertical cross-sectional view of the dielectric waveguide filter shown in FIG. 1 and depicting the internal RF signal direct and indirect transmission and coupling paths.
Figure 7:
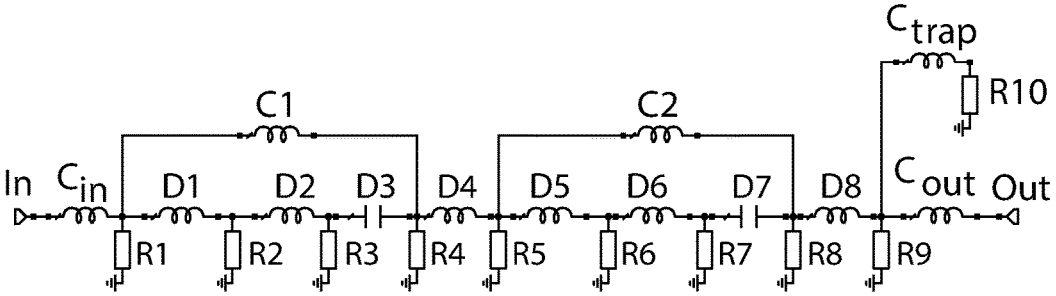
FIG. 7 is a schematic diagram of the electrical circuit of the dielectric waveguide filter shown in FIG. 1.
Figure 8:
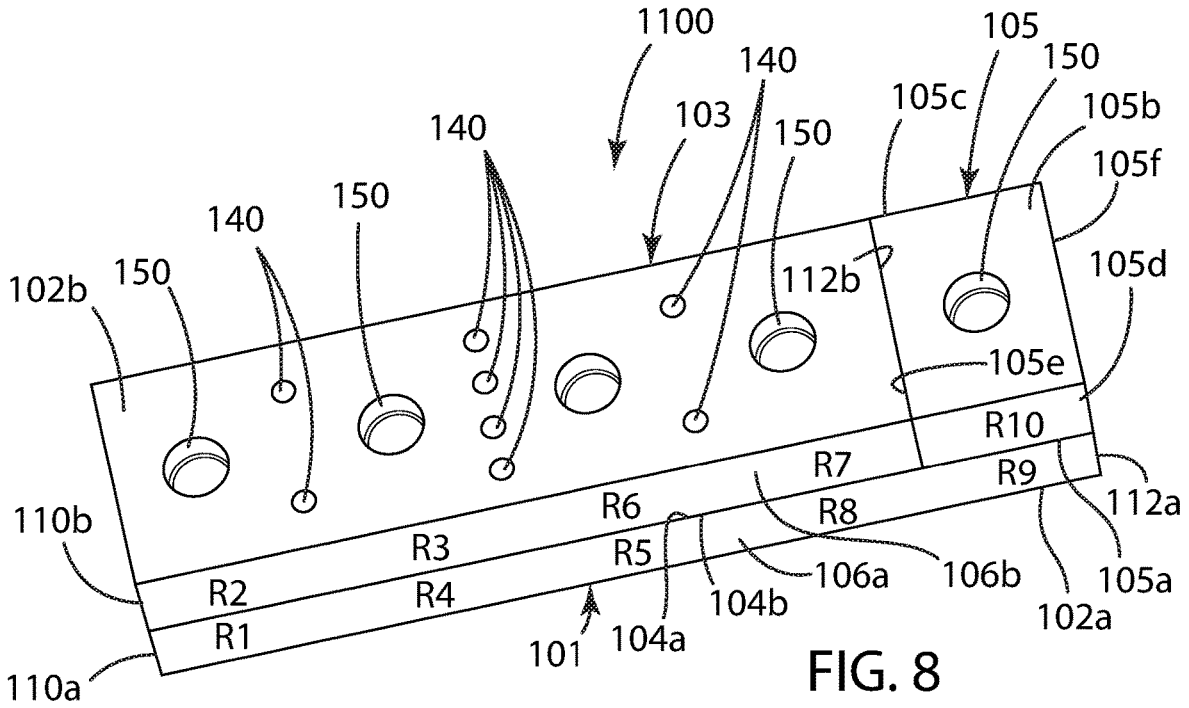
FIG. 8 is a top perspective view of another embodiment of a dielectric waveguide filter in accordance with the present invention.
Figure 9:
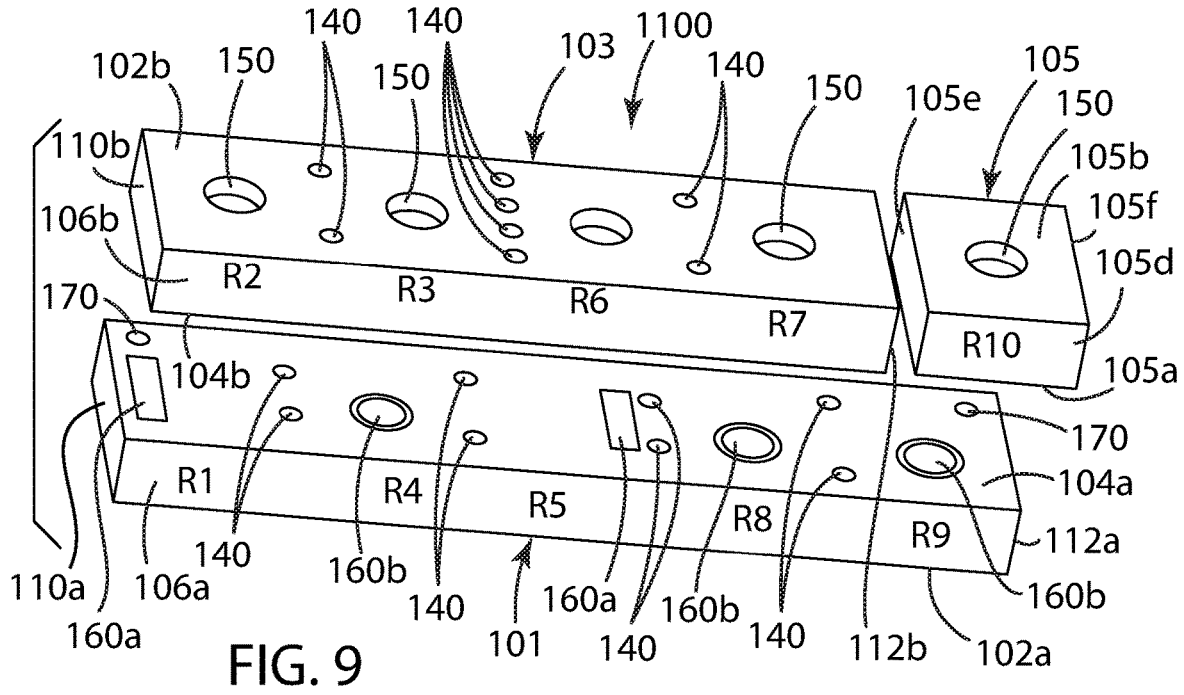
FIG. 9 is an exploded perspective view of the dielectric waveguide filter shown in FIG. 8.
Figure 10:
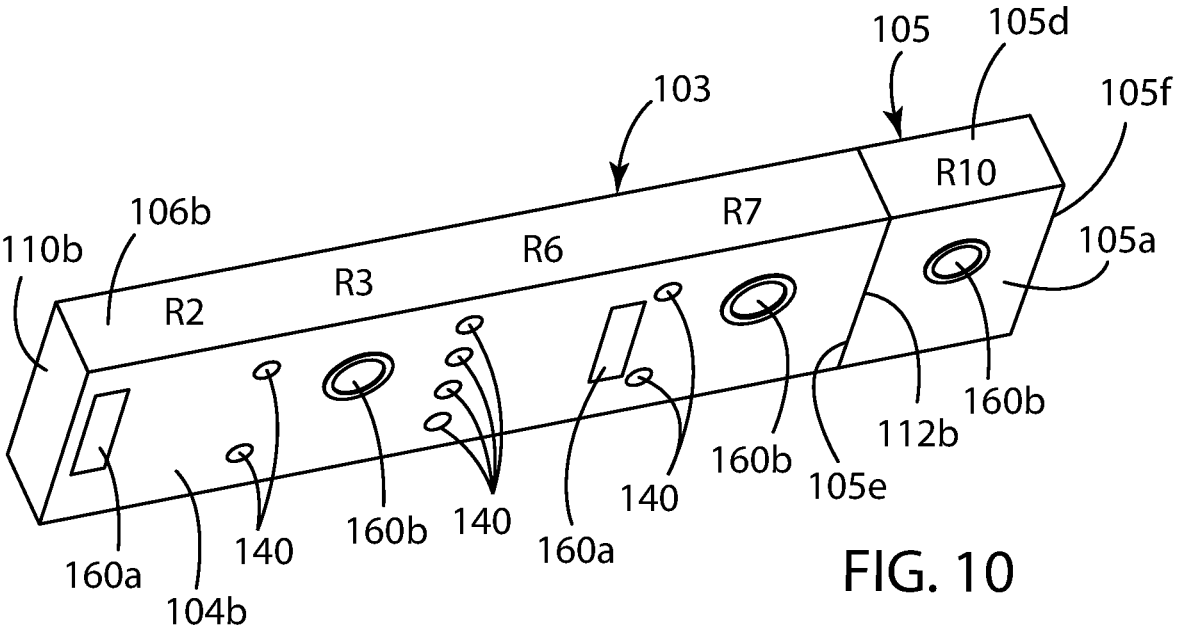
FIG. 10 is a bottom perspective view of the top block of the dielectric waveguide filter shown in FIG. 7.
Figure 11:
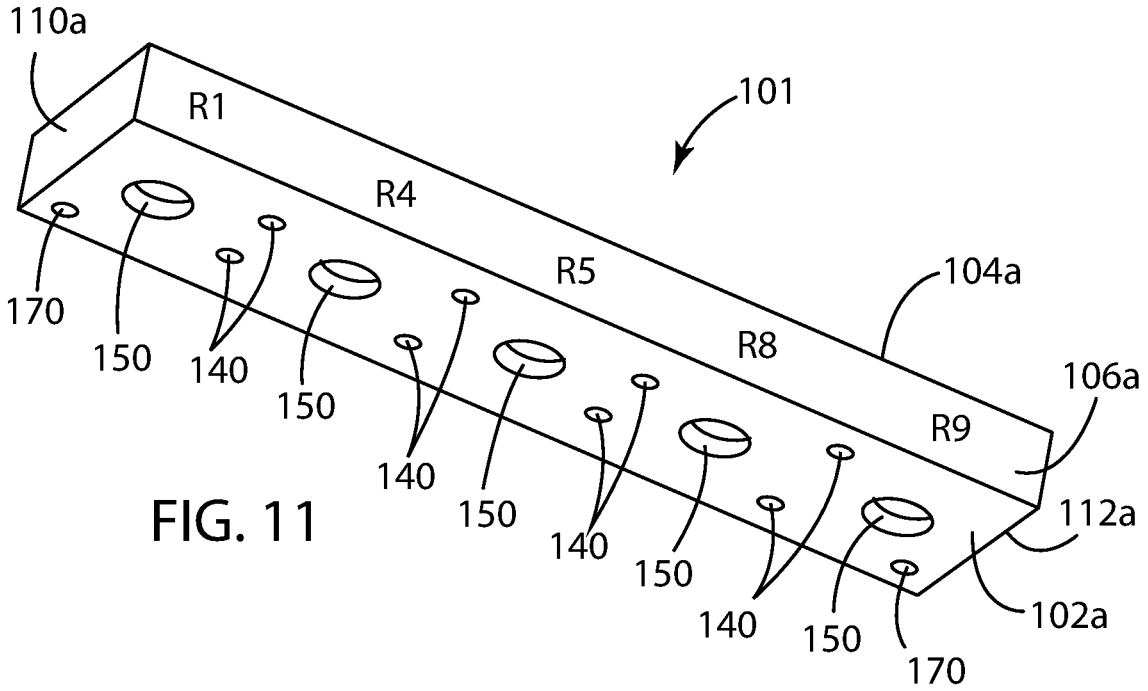
FIG. 11 is bottom perspective view of the bottom block of the dielectric waveguide filter shown in FIG. 7.
Figure 12:
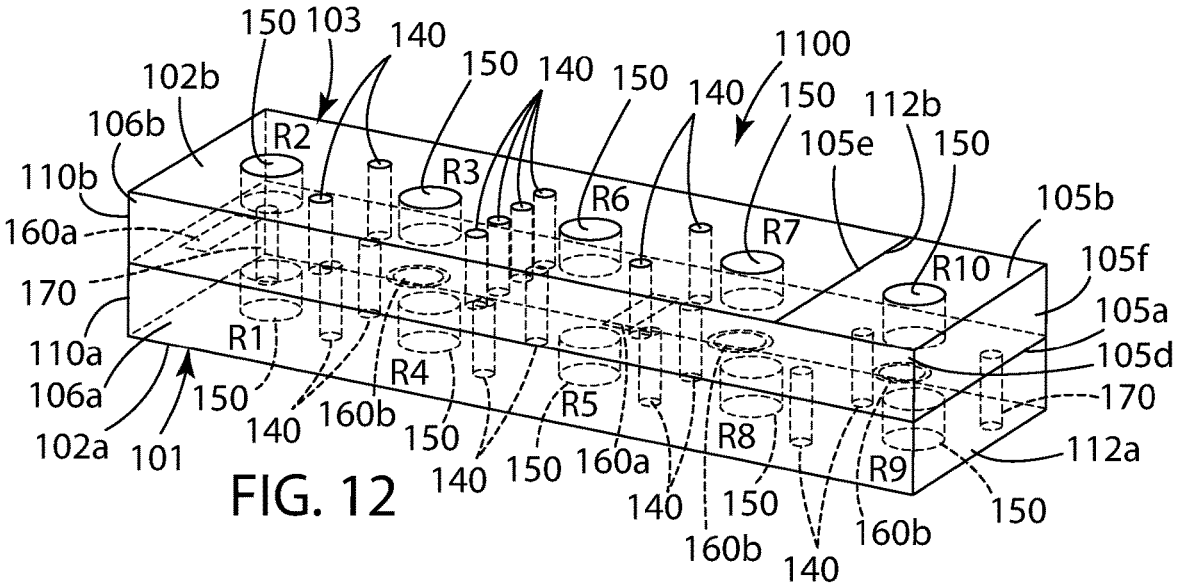
FIG. 12 is a part phantom perspective view of the dielectric waveguide filter shown in FIG. 7.
Figure 13:
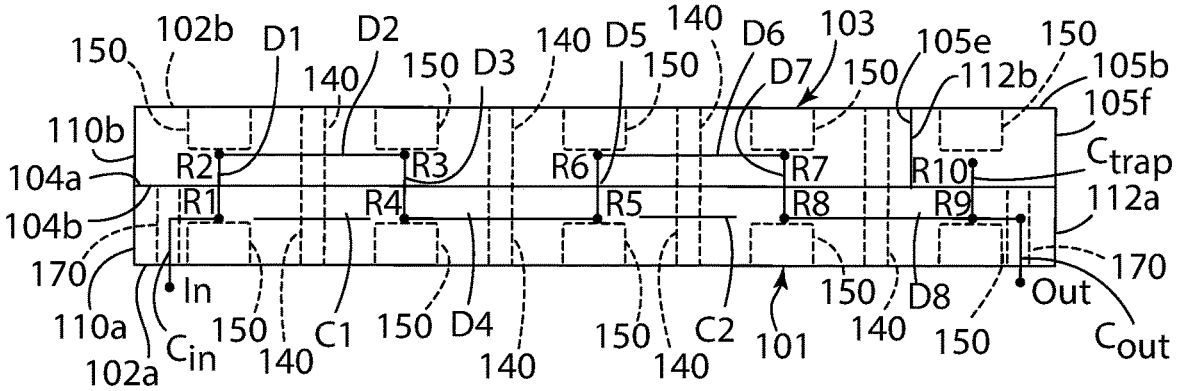
FIG. 13 is a part phantom vertical cross-sectional view of the dielectric waveguide filter shown in FIG. 7 and depicting the internal RF signal transmission and coupling paths.

The resonators in each of the monoblocks 101 and 103 are separated from each other by respective sets or groups of two or four spaced-apart and co-linear RF signal isolation through-holes 140 that extend between and terminate in respective openings in the upper and lower longitudinal exterior surfaces of the respective monoblocks 101 and 103. The number of through-holes 140 located between respective adjacent resonators is dependent upon the desired direct RF signal coupling (D2, D4, D6, and D8) or indirect or cross RF signal coupling (C1 and C2) or no coupling between respective ones of the resonators as shown in FIGS. 6 and 7.

In the embodiment of FIGS. 1-7, the number and location of the through-holes 140 in spaced-apart and co-linear relationship between the respective resonators in the monoblock 101 is as follows: two through-holes 140 located between the resonators R1 and R4 to provide an inductive cross-coupling C1 between the resonators R1 and R4; two through-holes 140 located between the resonators R4 and R5 to provide an inductive direct coupling D4 between the resonators R4 and R5; two through-holes 140 located between the resonators R5 and R8 to provide an inductive cross-coupling between the resonators R5 and R8; and two through-holes 140 located between the resonators R8 and R9 to provide an inductive direct coupling D8 between the resonators R8 and R9.

In the embodiment of FIGS. 1-7, the number and location of the through-holes 140 in spaced-apart and co-linear relationship between the respective resonators in the monoblock 103 is as follows: two through-holes 140 located between the resonators R2 and R3 to provide an inductive direct coupling D2 between the resonators R2 and R3; four through-holes 140 located between the resonators R3 and R6 to eliminate any coupling between the resonators R3 and R6; two through-holes 140 located between the resonators R6 and R7 to provide an inductive direct coupling D6 between the resonators R6 and R7; and four through-holes 140 located between the resonators R7 and R9 to eliminate any coupling between the resonators R7 and R9.

Each of the monoblocks 101 and 103 further includes and defines a plurality of (namely ten in the embodiment shown) circular recesses or counter-bores or grooves 150 extending inwardly into the interior of the respective monoblocks 101 and 103 from the respective monoblock longitudinal surfaces or faces 102*a* and 102*b*. In the embodiment shown, the recesses 150 are positioned and located in the center of each of the respective resonators of the respective monoblocks 101 and 103.

Each of the monoblocks 101 and 103 further includes and defines a plurality of RF signal transmission windows 160*a* and 160*b* positioned and located on the respective longitudinal exterior surfaces 104*a* and 104*b* of the respective monoblocks 101 and 103. A window 160*a* or 160*b* is located and positioned on each of the respective resonators defined on each of the respective monoblocks 101 and 103.

In the embodiment shown, and as described in more detail below, the windows 160*a* define inductive RF signal transmission means and are generally rectangular and comprise regions on the exterior longitudinal surfaces 104*a* and 104*b* of the respective monoblocks 101 and 103 which are devoid of conductive material (i.e., isolated regions of dielectric material).

Moreover, in the embodiment shown, the windows 160*b* define capacitive RF signal transmission means and are generally circular in shape and comprise isolated regions of conductive material on the exterior longitudinal surfaces 104*a* and 104*b* of the respective monoblocks 101 and 103 which are surrounded by regions devoid of conductive material (i.e., regions of dielectric material) which in turn are surrounded by regions of conductive material.

In the embodiment of FIGS. 1-7, the RF signal transmission windows 160*a* and 160*b* are located and defined on the monoblock 101 as follows: a window 160*a* is located and defined on each of the resonators R1 and R5; and a window 160*b* is located and defined on each of the resonators R4 and R8.

In the embodiment of FIGS. 1-7, the RF signal transmission windows 160*a* and 160*b* are located and defined on the monoblock 103 as follows: a window 160*a* is located and defined on each of the resonators R2 and R6; and a window 160*b* is located and defined on each of the resonators R3 and R7.

The monoblock 101 still further comprises respective interior RF signal input/output through-holes 170 extending through the body of the monoblock 101 between the respective upper and lower longitudinal surfaces 102*a* and 104*a* thereof and terminating in respective openings in the respective upper and lower longitudinal surfaces 102*a* and 104*a*. In the embodiment shown, the through-holes 170 are located and positioned and extend through the interior of the respective end resonators R1 and R9 of the monoblock 101.

All of the external surfaces 102*a*, 104*a*, 106*a*, 108*a*, 110*a*, and 112*a* of the monoblock 101, the interior surfaces of the respective recesses 150, the interior surfaces of the respective RF signal coupling through-holes 140, the interior surfaces of the respective RF signal input/output through-holes 170, and the exterior surfaces of the respective RF signal coupling windows 160*b* are covered with a suitable conductive material, such as for example silver.

Similarly, all of the exterior surfaces 102*b*, 104*b*, 106*b*, 110*b*, and 112*b* of the monoblock 103, the interior surfaces of the respective recesses 150, the interior surfaces of the respective RF signal coupling through-holes 140, the interior surfaces of the respective RF signal input/output through-holes 170, and the exterior surfaces of the respective RF signal coupling windows 160*b* are covered with a suitable conductive material, such as for example silver.

The separate monoblocks 101 and 103 are coupled to and stacked on each other in an abutting side-by-side relationship to define and form the waveguide filter 100 in a manner in which the separate monoblocks 101 and 103, and more specifically the respective resonators thereof, are arranged in an abutting and stacked/side-by-side relationship as described in more detail below.

Specifically, the monoblocks 101 and 103 are coupled to each other in a relationship wherein the longitudinal horizontal exterior surface 102*b* of the monoblock 103 is abutted against the longitudinal horizontal exterior surface 104*a* of the monoblock 101.

Still more specifically, the monoblocks 101 and 103 are stacked/coupled to each other in a side-by-side relationship wherein the surface 104*a* of the monoblock 101 is abutted against the surface 102*b* of the monoblock 103; a central interior layer 200 of conductive material which extends the length and width of the interior of the waveguide filter 100 is sandwiched between the surface 104*a* of the monoblock 101 and the surface 102*b* of the monoblock 103, and is defined by the layer of conductive material covering the length and width of the external surfaces 104*a* and 102*b* of the respective monoblocks 101 and 103; the longitudinal side vertical exterior surface 106*a* of the monoblock 101 is co-planarly aligned with the longitudinal side vertical exterior surface 106*b* of the monoblock 103; the respective through-holes 140 in the monoblock 101 are co-linearly aligned with respective through-holes 140 in the monoblock 103; the respective recesses 150 in the monoblock 101 are co-linearly aligned with the respective recesses 150 in the monoblock 103; the respective RF signal coupling windows 160*a* on the monoblock 101 are co-linearly aligned with and abutted against the respective RF signal coupling windows 160*a* on the monoblock 103; the respective RF signal coupling windows 160*b* on the monoblock 101 are co-linearly aligned and abutted against the respective RF signal coupling windows 160*b* on the monoblock 101; the opposed longitudinal side vertical exterior surface 108*a* of the monoblock 101 is co-planarly aligned with the longitudinal side vertical exterior surface 108*b* of the monoblock 103; the transverse end side vertical exterior surface 110*a* of the monoblock 101 is co-planarly aligned with the transverse side vertical exterior surface 110*b* of the monoblock 103; and the opposed transverse end side vertical exterior surface 112*a* of the monoblock 101 is co-planarly aligned with the opposed transverse end side vertical exterior surface 112*b* of the monoblock 103.

Thus, with the monoblocks 101 and 103 abutted against each other, the resonators in the respective monoblocks 101 and 103 are abutted and stacked on each other as follows: R1 and R2; R3 and R4; R5 and R6; R7 and R8; and R9 and R10.

In accordance with the embodiment of FIGS. 1-7, the abutting relationship of the respective RF signal coupling windows 160*a* and 160*b* with the two monoblocks 101 and 103 stacked against each other provides the following RF signal couplings as shown in FIGS. 6 and 7: the abutting windows 160*a* between the resonators R1 and R2 provide a direct inductive coupling between the resonator R1 in monoblock 101 and the resonator R2 in monoblock 103; the abutting windows 160*b* between the resonators R3 and R4 provide a direct capacitive coupling between the resonator R3 in the monoblock 103 and the resonator R4 in the monoblock 101; the abutting windows 160*a* between the resonators R5 and R6 provide a direct inductive coupling between the resonator R5 in the monoblock 101 and the resonator R6 in the monoblock 103; and the abutting windows 160*b* between the resonators R7 and R8 provide a direct capacitive coupling between the resonator R7 in the monoblock 103 and the resonator R8 in the monoblock 101.

In accordance with the invention, the waveguide filter 100 defines a first combination inductive and capacitive generally serpentine shaped direct coupling RF signal transmission path generally designated by the lines D1 through D8 as shown in FIGS. 6 and 7 and described in more detail below.

Initially, the RF signal is inputted/transmitted into the RF signal input/output through-hole 170 and into the end resonator R1 of the monoblock 101 via the coupling Cin the embodiment where the through-hole 170 in the resonator R1 of monoblock 101 defines the RF signal input through-hole 170.

Thereafter, the RF signal is transmitted in a direction normal to the monoblock longitudinal axis from the end resonator R1 in the monoblock 101 into the resonator R2 in the monoblock 103 via the RF signal transmission window 160*a* that is located between the resonators R1 and R2; the RF signal then travels in the direction of the monoblock longitudinal axis into the adjacent resonator R3 in monoblock 103 via and through and around the isolation through-holes 140 located between the resonators R2 and R3; then in a direction normal to the monoblock longitudinal axis from the resonator R3 in the monoblock 103 and into the resonator R4 in the monoblock 101 via the RF signal transmission window 160*b* located between the resonators R3 and R4; then in the same direction as the monoblock longitudinal axis from the resonator R4 in the monoblock 101 and into the adjacent resonator R5 in the monoblock 101 via and through and around the isolation through-holes 140 located between the resonators R4 and R5; then in a direction normal to the monoblock longitudinal axis from the resonator R5 in the monoblock 101 and into the resonator R6 of the monoblock 103 via and through the RF signal transmission window 160*a* located between the resonators R5 and R6; then in the same direction as the monoblock longitudinal axis from the resonator R6 in the monoblock 103 and into the resonator R7 in the monoblock 103 via and through and around the isolation through-holes 140 located between the adjacent resonators R6 and R7; then in a direction normal to the monoblock longitudinal axis from the resonator R7 in the monoblock 103 and into the resonator R8 in the monoblock 101 via and through the RF signal transmission window 160*b* located between the resonators R7 and R8; then in the same direction as the monoblock longitudinal axis from the resonator R8 in the monoblock 101 and into the resonator R9 in the monoblock 101 via and through and around the isolation through-holes 140 located between the resonators R8 and R9; and then from the end resonator R9 in the monoblock 101 via coupling Cout and into and through the RF signal input/output through-hole 170 in the embodiment where the RF signal input/output through-hole 170 comprises the output for the RF signal.

The waveguide filter 100 also defines and provides an alternate or indirect- or cross-coupling RF signal transmission path for RF signals generally designated by the lines C1 and C2 as shown in FIGS. 6 and 7.

Specifically, a first cross-coupling or indirect inductive RF signal transmission path C1 is defined and created in the same direction as the monoblock longitudinal axis between the resonators R1 and R4 in the monoblock 101 and a second cross-coupling or indirect inductive RF signal transmission path C2 is defined and created in the same direction as the monoblock longitudinal axis between the resonators R5 and R8 in the monoblock 101.

Figure 15:
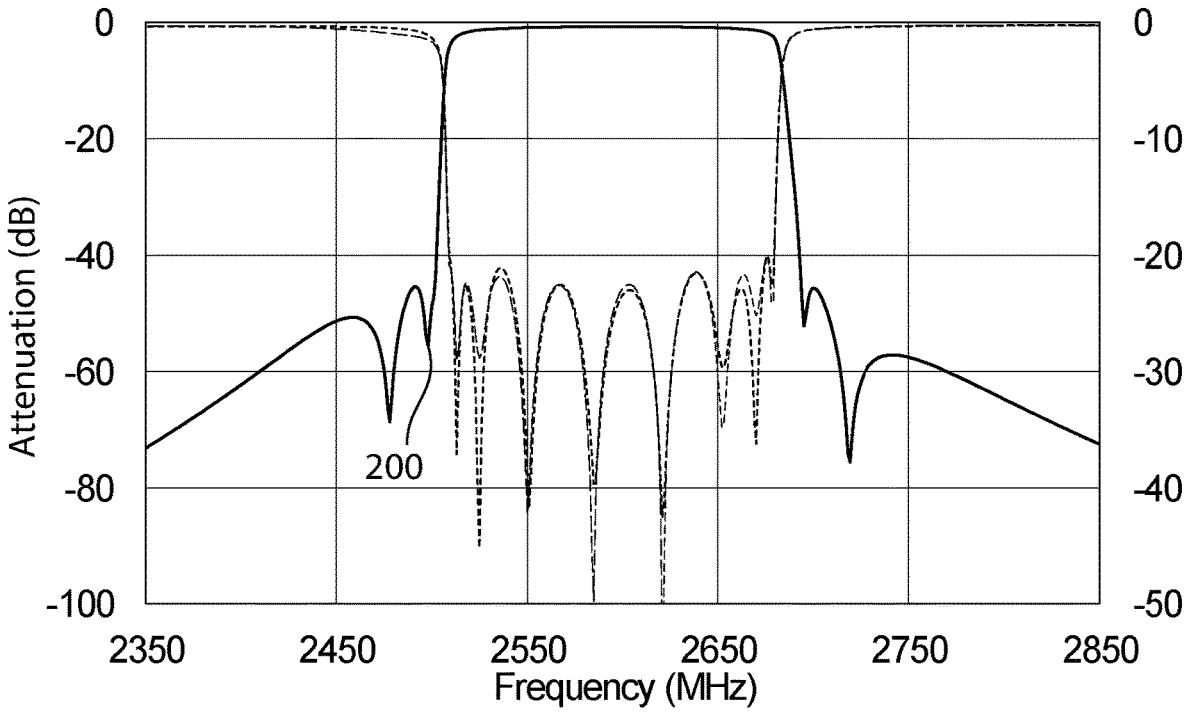
FIG. 15 is a graph depicting the performance of the dielectric waveguide filters shown in the FIGS.

Moreover, and as shown in FIGS. 6 and 7, the combination of the respective recesses 150 in the respective end resonators R9 and R10 of the respective monoblocks 101 and 103; the abutting RF signal transmission windows 160*a* located between the end resonators R9 and R10; and the RF signal input/output through-hole 170 in the end resonator R9 of the monoblock 101 define a trap resonator R10 in the monoblock 103 that defines and forms the notch 200 in the graph of FIG. 15.

More specifically, and although the resonator R7 in the monoblock 103 is located adjacent and in a side-by-side relationship with the end resonator R10 in the monoblock 103, there is no direct RF signal coupling between the resonator R7 and the end resonator R10 in the direction of the monoblock longitudinal axis due to the presence of the four RF signal isolation through-holes 140 positioned between the resonators R7 and R10. Instead, there is an inductive trap coupling Ctrap defined between the resonators R9 and R10 in the respective monoblocks 101 and 103, i.e., the resonator R10 in the monoblock 103 is coupled to the resonator R9 in the monoblock 101 through the RF signal coupling window 160*a* located between the resonators R10 and R9 to function as an external or isolated trap resonator R10.

FIGS. 8 through 14 depict another embodiment of a dielectric waveguide filter 1100 which is similar in structure to the dielectric waveguide 100, and thus the earlier description of the elements, structure and function of the dielectric waveguide filter 100 is incorporated herein by reference in connection with the description of the elements, structure, and function of the dielectric waveguide filter 1100, except that in the waveguide filter 1100 the resonator R10 is in the form of a separate third solid block of dielectric material 105; the RF coupling window 160*a* between the resonator R9 on the first solid block of dielectric material 101 and the third solid block of dielectric material 105 has been substituted with a capacitive RF signal coupling window 160*b* comprising an isolated pad of conductive material on the respective exterior surfaces of the first and third blocks of dielectric material 101 and 105 respectively that is surrounded by a region or ring of dielectric material; and the RF signal isolator between the resonators R7 and R10 comprises an elongate slot 107 defined between the adjacent end faces or surfaces of the respective monoblocks 103 and 105 that prevents the transmission of the RF signal between the end resonator R7 in the block 103 and the resonator R10 in the block 105.

Specifically, the third solid block of dielectric material 105, like the blocks 101 and 103, is a generally parallelepiped-shaped monoblock with a solid core of dielectric material and including opposed top and bottom exterior longitudinal horizontal surfaces or faces 105*a* and 105*b*, opposed longitudinal side vertical exterior surfaces or faces 105*c* and 105*d* that are disposed in a relationship normal to and extend between the horizontal exterior surfaces 105*a* and 105*b*, and opposed transverse end side vertical surfaces or faces 105*e* and 105*f* that are disposed in a relationship generally normal to and extend between the longitudinal horizontal exterior surfaces 105*a* and 105*b* and the longitudinal vertical exterior surfaces 105*c* and 105*d*.

The monoblock or block 105 includes and defines a circular recess or counter-bore 150 extending inwardly into the interior of the monoblock 105 from the top exterior surface or face 105*a*. In the embodiment shown, the recess 150 is centrally located on the monoblock 105.

All of the exterior surfaces 105*a*, 105*b*, 105*c*, 105*d*, 105*e*, and 105*f* of the monoblock 105 including the exterior surfaces of the recess 150 defined therein are covered with a suitable conductive material, such as for example silver.

The monoblock 105 also includes and defines the capacitive RF signal coupling window 160*b* in the form of an isolated pad of conductive material on the bottom exterior surface or face 105*b* of the monoblock 105 that is surrounded by a region or ring of dielectric material which in turn in surrounded by a region of conductive material.

Although not shown in the FIGS, it is understood that in the waveguide filter embodiment 1100 as shown in FIGS. 8-14, the inductive RF coupling window 160*a* formed in the region of the resonator R9 of the monoblock 101 in the filter embodiment of FIGS. 1-7 has been substituted with a capacitive RF signal coupling window 160*b* in the form of an isolated pad of conductive material on the top exterior surface 104*a* of the monoblock 101.

Figure 14:
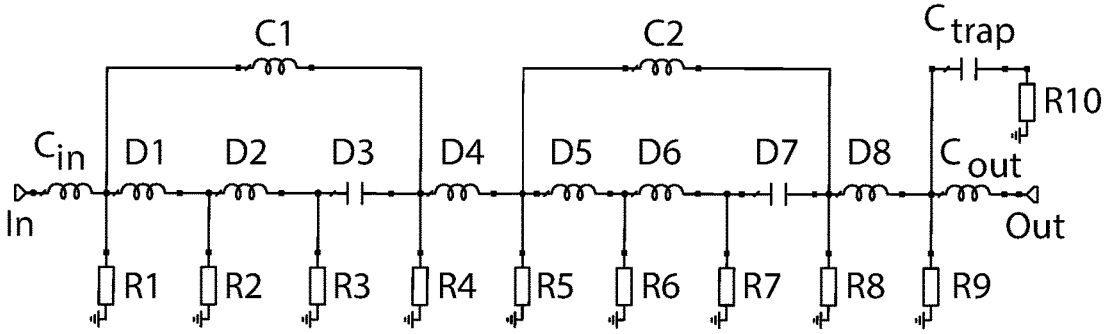
FIG. 14 is a schematic diagram of the electrical circuit of the dielectric waveguide filter shown in FIG. 7.

Further, in the embodiment of FIG. 14, the second block of dielectric material 103 is shorter than the first block of dielectric material 101 to allow mounting and abutting of the third block of dielectric material 105 against the first block 101 and adjacent the second block 103 in the region of the end resonator R9 of the block 101 in a relationship wherein the end face 105*e* of the block 105 is positioned in a relationship spaced, adjacent and parallel to the end face 112*b* of the block 103; the end face 105*f* of the block 105 is positioned in a relationship co-planar with the end face 112*a* of the block 101; the bottom exterior face 105*a* of the block 105 is abutted against the top exterior face 104*a* of the block 101; and the RF signal coupling window 160*b* on the bottom exterior face 105*a* of the block 105 is abutted against the RF signal coupling window 160*b* on the top exterior face 104*a* of the block 101.

In accordance with the embodiment of FIGS. 8 through 13, the space between the respective adjacent end faces 112*b* of the block 103 and the end face 105*e* of the block 105 defines and forms an elongate slot 107 between the blocks 103 and 105 defining a RF signal isolator.

More specifically, and although the resonator R7 in the monoblock 103 is located adjacent and in a side-by-side relationship with the end resonator R10 defined by the block 105, there is no direct RF signal coupling between the resonator R7 and the end resonator R10 in the direction of the monoblock longitudinal axis due to the presence of the elongate slot 107 between the resonators R7 and R10. Instead, there is a capacitive trap coupling Ctrap defined between the resonators R9 and R10 in the respective monoblocks 101 and 105, i.e., the resonator R10 in the monoblock 105 is coupled to the resonator R9 in the monoblock 101 through the capacitive RF signal coupling window 160*a* located between the resonators R10 and R9 to function as an external or isolated trap resonator R10.

While the invention has been taught with specific reference to the embodiments shown, it is understood that a person of ordinary skill in the art will recognize that changes can be made in form and detail without departing from the spirit and the scope of the invention. The described embodiments are to be considered in all respects only as illustrative and not restrictive.

For example, it is understood that the configuration, size, shape, and location of several of the elements of the waveguide filter including, but not limited to, the resonators, windows, and through-holes may be adjusted or varied depending upon the particular application or desired performance characteristics of the waveguide filter.

What is claimed is:

1. A dielectric waveguide filter comprising:

a first solid block of dielectric material covered with a layer of conductive material and defining a plurality of resonators;

a second solid block of dielectric material coupled to the first solid block of dielectric material, the second block of dielectric material covered with a layer of conductive material and defining a plurality of resonators including first and second adjacent resonators separated by an RF signal isolator for preventing the transmission of an RF signal between the first and second resonators; and an RF signal coupling window providing a coupling between a first one of the plurality of resonators of the first block of dielectric material and the first resonator of the second block of dielectric material whereby the first resonator of the second block of dielectric material defines a trap resonator.

2. The dielectric waveguide filter of claim 1 wherein a first RF signal input/output is defined on an end one of the plurality of resonators of the first solid block of dielectric material and the first and second adjacent resonators of the second solid block of dielectric material comprised end ones of the resonators of the second solid block of dielectric material.

3. The dielectric waveguide filter of claim 1 wherein the RF signal isolator comprises a plurality of spaced apart through-holes positioned between the first and second adjacent resonators.

4. The dielectric waveguide filter of claim 1 wherein the RF signal coupling window is defined by a region on the first and second solid blocks of dielectric material that is devoid of conductive material.

5. The dielectric waveguide filter of claim 1 further comprising a first RF signal input/output on the first one of the plurality of resonators of the first block of dielectric material.

6. A dielectric waveguide filter comprising:

a first solid block of dielectric material covered with a layer of conductive material and defining a plurality of resonators;

a first RF signal input/output on a first end resonator of the plurality of resonators of the first block of dielectric material;

a second solid block of dielectric material coupled to the first solid block of dielectric material, the second block of dielectric material covered with a layer of conductive material and defining a plurality of resonators including first and second adjacent end resonators separated by an RF signal isolator for preventing the transmission of an RF signal between the first and second end resonators; and an RF signal coupling window for providing a coupling between the first end resonator of the plurality of resonators of the first block of dielectric material and the first end resonator of the second block of dielectric material whereby the first end resonator of the second block of dielectric material defines a trap resonator.

7. The dielectric waveguide filter of claim 6 wherein the RF signal isolator comprises a plurality of spaced apart through-holes positioned between the first and second adjacent resonators.

8. The dielectric waveguide filter of claim 6 wherein the RF signal coupling window is defined by a region on the first and second solid blocks of dielectric material that is devoid of conductive material.

9. A dielectric waveguide filter comprising:

a first solid block of dielectric material covered with a layer of conductive material and defining a plurality of resonators;

a second solid block of dielectric material coupled to the first solid block of dielectric material, the second block of dielectric material covered with a layer of conductive material and defining a plurality of resonators including a first end resonator;

a third solid block of dielectric material coupled to the first solid block of dielectric material and positioned adjacent an end of the second solid block of dielectric material and defining a resonator; a slot between the second and third solid blocks of dielectric material and defining an RF signal isolator for preventing the transmission of an RF signal between the first end resonator of the second solid block of dielectric material and the resonator of the third solid block of dielectric material; and an RF signal coupling window providing a coupling between a first one of the plurality of resonators of the first block of dielectric material and the resonator of the third block of dielectric material whereby the resonator of the third block of dielectric material defines a trap resonator.

10. The dielectric waveguide filter of claim 9 wherein the third solid block of dielectric material that is coupled to the first and second solid blocks of dielectric material is abutting an end region of the first solid block of dielectric material.

11. The dielectric waveguide filter of claim 9 wherein the slot is an elongate slot.

12. The dielectric waveguide filter of claim 9 wherein the RF signal coupling window is defined by a capacitive coupling isolated pad of conductive material on the first and third solid blocks of dielectric material.

* * * * *